US006715527B2

(12) United States Patent
Ardoin

(10) Patent No.: US 6,715,527 B2
(45) Date of Patent: Apr. 6, 2004

(54) VENTILATION APPARATUS FOR GARAGES

(76) Inventor: Raymond V. Ardoin, 1409 Olday Rd., Lot 35, Pearland, TX (US) 77581

( * ) Notice: Subject to any disclaimer, the term of this patent is extended or adjusted under 35 U.S.C. 154(b) by 0 days.

(21) Appl. No.: 10/287,712

(22) Filed: Nov. 5, 2002

(65) Prior Publication Data

US 2003/0106652 A1 Jun. 12, 2003

Related U.S. Application Data

(60) Provisional application No. 60/338,664, filed on Dec. 11, 2001.

(51) Int. Cl.[7] ..... E06B 3/32

(52) U.S. Cl. ..... 160/104; 160/113; 49/171

(58) Field of Search ..... 160/104, 113, 160/92, 201, 89; 49/70, 74.1, 82.1, 87.1, 73.1, 143, 163, 169, 171; 454/195, 277

(56) References Cited

U.S. PATENT DOCUMENTS 2,616,498 A * 11/1952 Wisner et al. ..... 160/104
3,039,155 A * 6/1962 Iacovoni ..... 160/104
3,178,776 A * 4/1965 Stansberry ..... 160/113
3,927,709 A * 12/1975 Anderson et al. ..... 160/201 X
4,141,403 A * 2/1979 Church ..... 160/201
4,378,043 A 3/1983 Sorenson
4,537,237 A * 8/1985 Sepulveda et al. ..... 160/201
4,770,087 A * 9/1988 Danley et al. ..... 160/92 X
5,976,009 A 11/1999 Achen
6,092,580 A 7/2000 Lucas
6,209,613 B1 * 4/2001 Forry ..... 160/199
6,386,969 B1 * 5/2002 O'Brien ..... 454/195

* cited by examiner

*Primary Examiner*—David Purol
(74) *Attorney, Agent, or Firm*—Richard C. Litman

(57) ABSTRACT

A ventilator for installation in a garage door. It preferably fits in place of a standard garage door panel or into the panel. The ventilator includes a frame fitting into the door in place of a panel. The ventilator has openable and closeable louver slats exposed to the outside of the door and operated by a crank located on the inside of the door for adjustment of the louver slats to the desired position. A screen of appropriate mesh is installed on the frame on the inside of the garage, covering the inside such that insects may not enter the garage when the louver slats of the ventilator are open. The ventilator is preferably made of aluminum or other metal and is of sufficiently robust construction as to deter forcible intrusion, particularly when the ventilator is closed.

3 Claims, 3 Drawing Sheets

VENTILATION APPARATUS FOR GARAGES

CROSS-REFERENCE TO RELATED APPLICATION

This application claims the benefit of U.S. Provisional Patent Application Serial No. 60/338,664, filed Dec. 11, 2001.

BACKGROUND OF THE INVENTION

1. Field of the Invention

The present invention relates to garage ventilators. More particularly, the present invention relates to louvered ventilators which fit within a standard garage door panel.

2. Description of Related Art

Ventilators for incorporation into garage doors are known. Many of them are mere screens and offer little security and no adjustability as to the degree of ventilation. These screen devices may have a separately installed inner backing plate to shut off the ventilation, or may fold up against solid panels of the garage door. Some must be entirely removed from the garage door when ventilation is not desired, such as in winter. Most present screen devices offer little resistance to forcible intrusion. It would be desirable to provide a garage ventilator which is rugged in construction to foil forcible intrusion, is adjustable between an open and a closed position for selective ventilation, and incorporates a screen for denying entrance of insects into the garage when in an open position.

U.S. Pat. No. 4,378,043, issued Mar. 29, 1983, to Sorenson describes a garage ventilator having a screen panel pivotally secured to the bottom of a sectional garage door.

U.S. Pat. No. 4,770,087, issued Sep. 13, 1988 to Danley et al. describes a garage ventilator for fitting in a standard garage door panel which features fixed louvers and a backup screen for preventing entry of insects. The ventilator has a backup panel for closing off the ventilator when ventilation is not needed.

U.S. Pat. No. 4,323,104, issued Apr. 6, 1982, to Guttman describes an openable and closeable louvered panel operated by a crank for a door or window opening. No screen is provided for keeping out insects when the louvers are open.

None of the above inventions and patents, taken either singly or in combination, is seen to describe the instant invention as claimed.

SUMMARY OF THE INVENTION

The present invention is a ventilator for installation in a garage door. It preferably fits in place of a standard garage door panel or into the panel. The ventilator includes a frame fitting into the door in place of a panel. The ventilator has openable and closeable louver slats exposed to the outside of the door and operated by a crank located on the inside of the door for adjustment of the louver slats to the desired position. A screen of appropriate mesh is installed on the frame on the inside of the garage, covering the inside such that insects may not enter the garage when the louver slats of the ventilator are open. The ventilator is preferably made of aluminum or other metal and is of sufficiently robust construction as to deter forcible intrusion, particularly when the ventilator is closed.

Accordingly, it is a principal object of the invention to provide a ventilator for ventilating a garage which fits into the garage door.

It is another object of the invention to provide a ventilator as above which fits in place of a standard garage door panel in an aesthetic manner.

It is a further object of the invention to provide a ventilator as above having louver slats which may be adjusted between an open and a closed position.

Still another object of the invention is to provide a ventilator as above which has a crank accessible only from the inside of the garage for easily adjusting the ventilator.

It is yet another object of the invention to provide a ventilator as above which incorporates a screen to exclude insects while the ventilator is open.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a ventilator for installation in a garage door. It preferably fits in place of a standard garage door panel or into the panel. The ventilator includes a frame fitting into the door in place of a panel. The ventilator has openable and closeable louver slats exposed to the outside of the door and operated by a crank located on the inside of the door for adjustment of the louver slats to the desired position. A screen of appropriate mesh is installed on the frame on the inside of the garage, covering the inside such that insects may not enter the garage when the louver slats of the ventilator are open.

Figure 1:
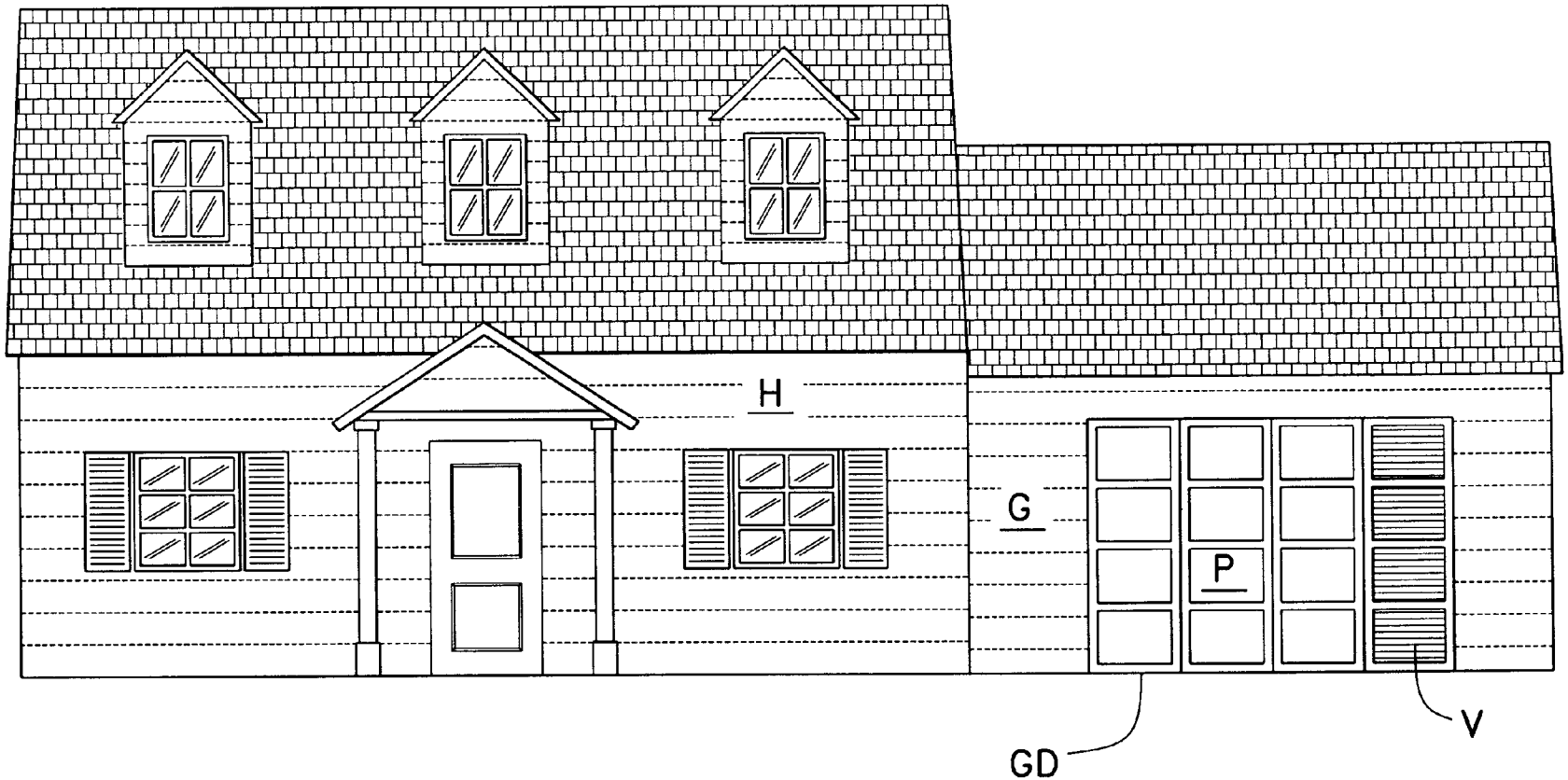
FIG. 1 is an environmental view of a ventilator for garages according to the present invention.

Referring to FIG. 1. there is shown an environmental view of the inventive ventilator. House H has attached garage G with overhead garage door GD having standard panels P. One or more inventive ventilators V are fit in place of standard panels P in order to provide ventilation to the inside of garage G when desired.

Figure 2:
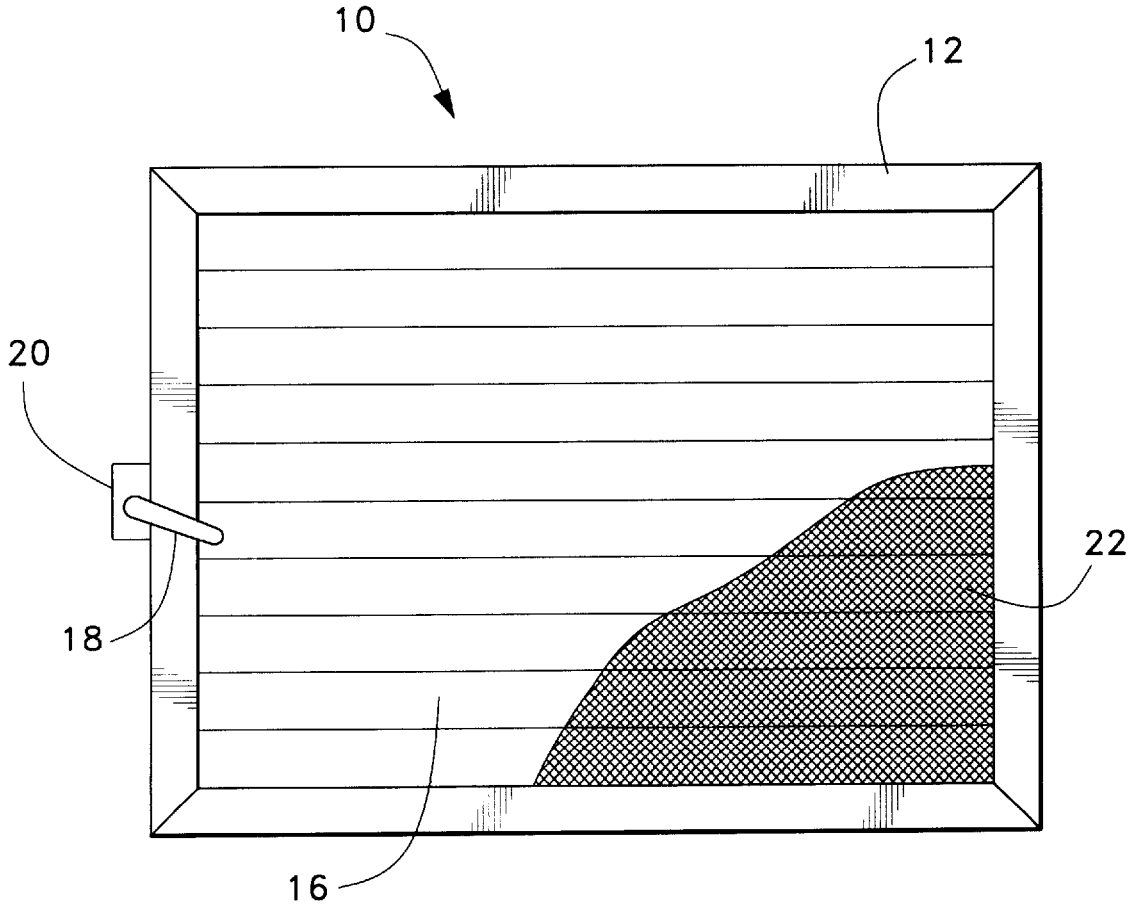
FIG. 2 is a rear view of the ventilator of FIG. 1 with the screen partially cut away.

Referring to FIG. 2, there is shown a rear view of the ventilator 10 in a closed position as seen from the inside of the garage G comprising an outer frame 12 supporting louver slats 16 which are subject to opening and closing by the action of crank 20 acting on gears(not shown) in casing 20 mounted on frame 12. Screen 22 is mounted on the rear of outer frame 12 and is of such mesh size as to prevent insects from entering the interior of the garage through the open ventilator. The ventilator is preferably made of aluminum or other metal and is of sufficiently robust in construction as to deter forcible intrusion, particularly when in a closed position.

Figure 3:
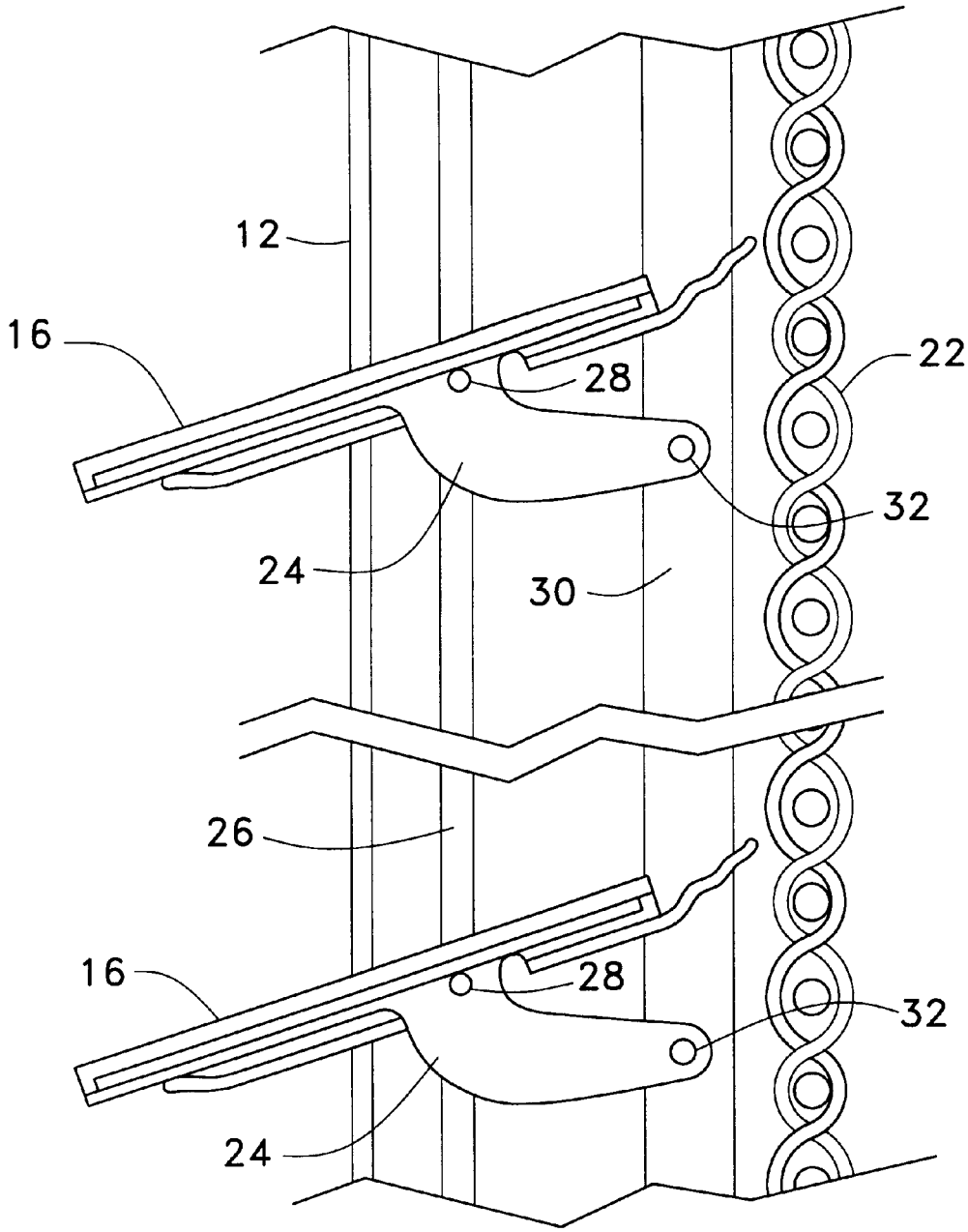
FIG. 3 is a partial side view is section of the ventilator of FIG. 1, illustrating the rotatable louver slats and the inner screen.

Referring to FIG. 3, there is shown a partial sectional side view of the ventilator 10 in an open position wherein frame 12 supports inner screen 22. Louver slats 16 are supported for rotation by slat supports 24 on pivot upright 26 by means of pivot bearing 28 and pivoting is actuated by vertical movement of slat actuating upright 30 by means of actuating bearing 32. Vertical movement of slat actuating upright 30 is effected by means of turning ventilator crank 18 which acts on gears such as rack and pinion gears(not shown) or the equivalent in a known manner.

In operation, crank 20 is turned by the user in one direction to pull slat actuating upright downward, thus pivoting louver slats 16 to an open position as shown in FIG. 3. Crank 20 is turned in the opposite direction to pivot louver slats 16 to an intermediate position or a closed position as shown in FIG. 2.

The ventilator of the present invention may be constructed in a variety of sizes to match various standard garage door panels. The construction of the ventilator is preferably robust to deter forcible entry into the garage, particularly in the closed position, and may be made of suitable metal, plastic, or composite material.

It is to be understood that the present invention is not limited to the sole embodiment described above, but encompasses any and all embodiments within the scope of the following claims.

I claim:

1. A ventilated garage door comprising in combination:

a garage door having a plurality of panels; and a ventilator replacing one of said plurality of panels, said ventilator including:

a frame sized to replace one of said panels, said frame having an inner side facing interiorly of the garage door and an outer side facing exteriorly of the garage door when said garage door is in a closed position;

a plurality of parallel louver slats supported within said frame for rotation between an open position and a closed position;

a screen supported by said frame and of such mesh size as to exclude the admission of insects when said garage door is in the closed position and said louver slats are in the open position; and a gearbox located on said frame, said gearbox having a handle and an actuator attached to said louver slats;

whereby upon turning said handle in one direction, said gearbox acts upon said actuator to rotate said louver slats to the closed position, and whereby upon turning said handle in an opposite direction, said gearbox acts upon said actuator to rotate said louver slats to the closed position.

2. The ventilated garage door according to claim 1, wherein said screen is supported by the inner side of said frame, and said louver slats are supported for rotation within said frame and disposed outward from said screen.

3. The ventilator garage door according to claim 1, wherein said louver slats are horizontally disposed relative to said garage door and said frame.

* * * * *